US008695717B2

(12) United States Patent
Brennan, III et al.

(10) Patent No.: US 8,695,717 B2
(45) Date of Patent: Apr. 15, 2014

(54) INFLATABLE PACKER ASSEMBLY

(75) Inventors: William E. Brennan, III, Richmond, TX (US); Colin Longfield, Sugar Land, TX (US); Alexis Arzoumanidis, Boston, MA (US); Allessandro Caccialupi, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/591,868

(22) Filed: Aug. 22, 2012

(65) Prior Publication Data

US 2013/0126191 A1 May 23, 2013

Related U.S. Application Data

(60) Continuation of application No. 12/348,156, filed on Jan. 2, 2009, now abandoned, which is a continuation of application No. 12/025,874, filed on Feb. 5, 2008, now Pat. No. 7,578,342, which is a division of application No. 10/981,204, filed on Nov. 4, 2004, now Pat. No. 7,392,851.

(51) Int. Cl.
*E21B 33/127* (2006.01)

(52) U.S. Cl.
USPC ..... 166/387; 166/187

(58) Field of Classification Search
USPC ..... 166/387, 187, 180, 191
See application file for complete search history.

(56) References Cited

U.S. PATENT DOCUMENTS

| | | | |
|---|---|---|---|
| 1,549,468 | A | 8/1925 | Dumont |
| 2,828,823 | A | 4/1958 | Mounce |
| 3,542,127 | A | 11/1970 | Malone |
| 3,575,238 | A | 4/1971 | Shillander |
| 3,606,924 | A | 9/1971 | Malone |
| 3,690,375 | A | 9/1972 | Shillander |
| 3,915,229 | A | 10/1975 | Nicolas |
| 4,244,590 | A | 1/1981 | Sanford |
| 4,500,095 | A | 2/1985 | Schisler et al. |
| 4,544,165 | A | 10/1985 | Coone |
| 4,619,322 | A | 10/1986 | Armell et al. |
| 4,830,105 | A | 5/1989 | Petermann |

(Continued)

FOREIGN PATENT DOCUMENTS

| | | | |
|---|---|---|---|
| DE | 255420 | C | 6/1977 |
| EP | 0528327 | A2 | 2/1993 |

(Continued)

OTHER PUBLICATIONS

DFT—Drilling Formation Tester pamphlet, Pathfinder Energy Services Inc., pp. 1-2.

(Continued)

*Primary Examiner* — Nicole Coy
(74) *Attorney, Agent, or Firm* — John Vereb

(57) ABSTRACT

Conventional formation evaluation with dual inflatable packers includes the steps of pressurizing the packers so as to isolate an annular portion of the borehole wall, collecting one or more samples of formation fluid via the isolated portion of the borehole wall, and depressurizing the packers so as to permit movement of the mandrel within the borehole. A sampling method and apparatus that utilize one or more of the following to advantage is provided: restricting deformation of the packers during inflation using an annular bracing assembly; actively retracting the packers using ambient borehole pressure; and substantially centralizing the mandrel intermediate the packers so as to resist buckling of the mandrel.

2 Claims, 11 Drawing Sheets

(56) References Cited

U.S. PATENT DOCUMENTS

| | | | |
|---|---|---|---|
| 4,886,117 | A | 12/1989 | Patel |
| 4,923,007 | A | 5/1990 | Sanford et al. |
| 5,143,154 | A | 9/1992 | Mody et al. |
| 5,280,824 | A | 1/1994 | Eslinger et al. |
| 5,358,039 | A | 10/1994 | Fordham |
| 5,361,836 | A | 11/1994 | Sorem et al. |
| 5,404,947 | A | 4/1995 | Sorem et al. |
| 5,439,053 | A | 8/1995 | Eslinger et al. |
| 5,605,195 | A | 2/1997 | Eslinger et al. |
| 5,613,555 | A | 3/1997 | Sorem et al. |
| 5,687,795 | A | 11/1997 | Patel et al. |
| 5,782,298 | A | 7/1998 | Alexander et al. |
| 5,803,186 | A | 9/1998 | Berger et al. |
| 6,315,050 | B2 | 11/2001 | Vaynshteyn et al. |
| 6,513,600 | B2 | 2/2003 | Ross |
| 6,564,876 | B2 | 5/2003 | Vaynshteyn et al. |
| 6,752,205 | B2 | 6/2004 | Kutac et al. |
| 6,938,698 | B2 | 9/2005 | Coronado |
| 6,988,557 | B2 | 1/2006 | Whanger et al. |
| 7,096,954 | B2 | 8/2006 | Weng et al. |
| 7,373,812 | B2 | 5/2008 | Ma et al. |
| 2003/0121663 | A1 | 7/2003 | Weng et al. |
| 2010/0170682 | A1 | 7/2010 | Brennan, III et al. |

FOREIGN PATENT DOCUMENTS

| | | | |
|---|---|---|---|
| EP | 0528328 | A2 | 2/1993 |
| EP | 0702747 | B1 | 3/1996 |
| GB | 2003960 | A | 3/1979 |
| RU | 691553 | | 10/1979 |
| RU | 1273517 | | 11/1986 |
| RU | 1745918 | | 6/1990 |
| RU | 0222142 | | 1/2004 |
| WO | 03018956 | A1 | 3/2003 |

OTHER PUBLICATIONS

MDT Modular Formation Dynamics Tester pamphlet, Schlumberger, Jun. 2002, pp. 1-10.

INFLATABLE PACKER ASSEMBLY

The present application is a Continuation of U.S. patent application Ser. No. 12/348,156, filed Jan. 2, 2009, which is a Continuation of U.S. patent application Ser. No. 12/025,874 (U.S. Pat. No. 7,578,342), filed Feb. 5, 2008, which is a Divisional of U.S. patent application Ser. No. 10/981,204 (U.S. Pat. No. 7,392,851), filed Nov. 4, 2004.

BACKGROUND OF THE INVENTION

1. Field of the Invention

The present invention relates to inflatable packers having utility in downhole operations, particularly inflatable packers adapted for use in formation fluid sampling.

2. Background of the Related Art

Once an oil well has been drilled, it is often necessary for the operator to obtain downhole data, such as pressure measurements and downhole fluid samples for analysis. These tasks are commonly accomplished with downhole tools, such as modular wireline tools or drilling tools with evaluation capabilities, that employ probes for engaging the formation and establishing fluid communication to make the pressure measurements and acquire the fluid samples. Fluid is typically drawn into the downhole tool through an inlet in the probe. In some instances, such as for tight, low permeability, formations, sampling probes are often replaced by dual inflatable packer assemblies. Examples of such probe and packer systems are depicted, for example, in U.S. Pat. Nos. 4,860,581 and 4,936,139 assigned to Schlumberger.

FIGS. 1A-1B schematically illustrate a typical configuration of dual packer elements 10 in their respective deflated and inflated conditions. The packer elements 10 are spaced apart along a downhole tool 12 conveyed by a wireline 14 in a borehole 18 penetrating a subsurface formation 20. Although a wireline tool is illustrated, other downhole tools conveyed by drill string, coiled tubing, etc. are also suited for such tasks. When inflated, the packer elements 10 cooperate to seal or isolate a section 16 of the borehole wall 18, thereby providing a flow area with which to induce fluid flow from the surrounding formation(s).

When inflating the packer elements (typically made of rubber), their ends often sustain large amounts of deformation and bending stresses, which may lead to circumferential tearing, and system failure. Additionally, since it is not uncommon for boreholes to exhibit high temperatures, particularly at great depths, the packer elements are often subjected to significant thermal stresses.

Attempts have been made to prevent packer failures. Accordingly, inflatable packer bodies or elements are often equipped with reinforcements in the form of metal cables or slats. While these reinforcements may be used to increase the life of the packer elements, the reinforcements may plastically deform and permit undesirable extrusion (as shown in FIGS. 1B-1C) under the high stresses imposed when the packer element is inflated and engages the wall 18 of a high temperature borehole. Additionally, the support members (i.e., the metal slats or cables) may have limited strength, and the flexible material of the packer element—typically rubber—may weaken with increasing temperature. The resulting deformation may be non-recoverable, thereby preventing the packer elements from retracting to within desirable diameters after sampling. In other words, the packers may fail to successfully return to the profile shown in FIG. 1A. Thus, when running these so-called "slat packers," there is an increased risk of getting stuck in the borehole.

Despite the advances in packer technology, there remains a need for a packer with a Song life under harsh wellborn conditions. It is desirable that such a packer limit or constrain the deformation that the packer undergoes during borehole operations so as to achieve a "milder" inflation profile (e.g., avoid the extruded profile of FIGS. 1B-1C) and thereby increase the life of the packer. Preferably, such a solution would be adaptable for use with known packer bodies or elements. It is further desirable mat the packers retract to their original shape (e.g., as seen in FIG. 1A) so as to reduce the likelihood of a downhole tool getting stuck in a borehole. Preferably, such a solution would use ambient borehole fluid pressure to achieve the desired retraction, and balance the loads applied to each of the packers of the downhole tool.

A further issue that arises in dual packer assemblies relates to die axial separation distance between the packer elements. As this distance is increased, e.g., to increase the isolated area of the borehole wall, the risk of buckling at the mandrel that separates the packers typically increases. Accordingly, a need exists for a solution to the buckling risk in spaced dual packer assemblies.

DEFINITIONS

Certain terms are defined throughout this description as they are first used, while certain other terms used in this description are defined below:

"Deployable" means movable from one position or configuration to another position or configuration, particularly by way of expansion or spreading out.

"Inwardly-facing" means facing towards the center or middle of an article or a set of articles (e.g., facing towards the center of a packer).

"Lower" means positioned deeper within a borehole (e.g., a lower end support of a packer having two end supports).

"Mandrel" means a bar, shaft, spindle or tubular member about which other components are arranged, assembled, or carried, particularly for performing one or more operations within a borehole.

"Outer" means positioned or located at a physical extreme or limit.

"Outwardly-facing" means facing away from the center or middle of an article or a set of articles (e.g., facing away from the center of a packer).

"Upper" means positioned shallower within a borehole (e.g., an upper packer of a dual packer configuration).

SUMMARY OF THE INVENTION

In one aspect, the present invention provides an inflatable packer assembly, including a first expandable tubular element having a pair of ends, and a first pair of annular end supports for securing the respective ends of the first tabular element about a mandrel disposed within the first tubular element. A first annular bracing assembly is deployable from one of the end supports for reinforcing the first tubular element upon pressurization and expansion thereof.

Preferably, the first annular bracing assembly is deployable by being pivotally-connected at one of its ends to one of the end supports. Alternatively, the deployable characteristic could be provided by other suitable extending or spreading means such as a piston-like engagement between the first annular bracing assembly (as a whole or by separate components thereof) with one of the end supports. Such alternatives are foreseen by the present invention and are considered to be within the scope thereof.

Preferably, one of the end supports is movable and the other end support is fixed with respect to the mandrel. However, the present invention extends to embodiments wherein both end supports are fixed with respect to the mandrel.

The first tubular element includes a flexible or elastomeric material that is known in the art. The end supports are preferably metallic and each include an annul us for receiving an end of the first tubular element.

The first annular bracing assembly is preferably expandable at its end opposite the pivotally connected end. Various embodiments of the annular bracing assembly employ a plurality of fingers or slats arranged in an annular configuration and each pivotally connected at one of its ends to either the movable end support or the fixed end support.

Where slats are employed by die annular bracing assembly, it is preferred that each of the slats has a width that increases from its pivotally connected end to its other end, and that the slats be arranged so that each slat partially overlaps an adjacent slat.

The packer assembly may include a pair of annular bracing assemblies each pivotally-connected at one of its ends to one of the first annular pair of end supports for reinforcing the first tubular element upon pressurization and expansion thereof.

The packer assembly will typically employ a mandrel adapted for use in a downhole tool in support of dual inflatable packers. Accordingly, the packer assembly may further include a second expandable tubular element having a pair of ends, and a second pair of annular end supports for securing the respective ends of the second tubular element about the mandrel. The first and second pair of end supports cooperate to define an axial separation distance between the first and second tubular elements. A second annular bracing assembly is pivotally connected at one of its ends to one of the second pair of end supports for reinforcing the second tubular element upon pressurization and expansion thereof.

Preferably, one of end supports of the second pair of end supports is movable and the other end support is fixed with respect to the mandrel.

In the packer assembly embodiments that employ dual packers, the lower end support of each of the first and second pairs of end supports is preferably a movable end support. Alternatively, the outer end supports among the first and second pairs of end supports are movable end supports.

Particular embodiments of the packer assembly are further equipped with a first retraction assembly for moving a movable end support of the first pair of end supports from an expanded position to a retracted position. Such embodiments may be further equipped with a second retraction assembly for moving a movable end support of the second pair of end supports from an expanded position to a retracted position. In these embodiments, it is preferred that the movable end support associated with each of the first and second retraction assemblies be equipped with an inwardly-facing surface area that exceeds its outwardly-facing surface area, whereby borehole fluid pressure imposes a net force above a low-pressure chamber that moves the movable end supports outwardly when the first and second tubular elements are depressurized and contracted.

Particular embodiments of the inventive packer assembly further include an expandable centralizer carried by the mandrel in the axial separation distance intermediate the first and second tubular elements for resisting buckling of the mandrel.

In another aspect, the present invention, provides an inflatable packer assembly, including a first expandable tubular element having a pair of ends, and a first pair of annular end supports for securing the respective ends of the first tubular element about a mandrel disposed within the first tubular element. One of the end supports is movable and the other end support is fixed with respect to the mandrel. A first stop member is provided for limiting the axial movement of the movable end support.

In particular embodiments, the movable end support is equipped with an inwardly-facing surface area that exceeds its outwardly-facing surface area, whereby borehole fluid pressure imposes a net force that moves the movable end support outwardly when the first tubular element is depressurized and contracted.

The packer assembly and the movable end support may be disposed for axial movement about a sleeve fixed to the mandrel. The sleeve has a stepped radius that corresponds to the inwardly-facing and outwardly-facing surface areas of the movable end support.

The packer assembly may further include a first annular bracing assembly pivotally-connected at one of its ends to one of the end supports for reinforcing the first tubular element upon pressurization and expansion thereof.

The packer assembly will typically employ a mandrel adapted for use in a downhole tool in support of dual inflatable packers. Accordingly, the packer assembly may further include a second expandable tubular element having a pair of ends, and a second pair of annular end supports for securing the respective ends of the second tubular element about the mandrel. One of the end supports is movable and the other end support is fixed with respect to the mandrel. A second stop member is provided for limiting the axial movement of the movable end support.

In particular embodiments, the movable end support is equipped with an inwardly-facing surface area that exceeds its outwardly-facing surface area, whereby borehole fluid pressure imposes a net force that moves the movable end support outwardly when the first tubular element is depressurized and contracted. The first and second pairs of end supports cooperate to define an axial separation distance between the first and second tubular elements. Such embodiments of the packer assembly may further include a second annular bracing assembly pivotally-connected at one of Its ends to one of the end supports for reinforcing the second tubular element upon pressurization and expansion thereof.

In a still further aspect, the present invention provides an inflatable packer assembly, including a pair of inflatable packers disposed about a mandrel adapted for use in a downhole tool disposed in a borehole, the packers being spaced apart by an axial separation distance. An expandable centralizer is carried by the mandrel in the axial separation distance intermediate the first and second packers for resisting buckling of the mandrel.

The centralizer may include a pair of supports carried along the mandrel with, at least one of the supports being axially-movable along the mandrel. The centralizer of these embodiments further includes a plurality of (preferably at least three) pairs of hinged arms. The arms of each pair have first ends pivotally connected to the respective supports and second ends pivotally connected to each other. An actuator is carried by the mandrel for inducing axial movement of each movable support such that the pivotally-connected second ends of each pair of arras is moved radially outwardly to exert a force on the borehole wall that substantially centers the mandrel in the borehole.

The centralizer may further include a plurality of spring blades each having ends pivotally connected to the respective supports so as to position the spring blades between the respective pairs of hinged arms and the borehole wall. The spring blades and hinged arms cooperate to exert forces on the borehole wall that substantially centers the mandrel in the borehole.

A still further aspect of the present invention relates to a method of deploying a pair of spaced-apart inflatable packers carried about a mandrel disposed in a borehole penetrating a subsurface formation. The method includes the steps of pressurizing the packers so as to isolate an annular portion of the borehole wall, collecting one or more samples of formation fluid via the isolated portion of the borehole wall, and depressurizing the packers so as to permit movement of the mandrel within the borehole. The method further includes one or more of the following steps: restricting deformation of the packers during the pressurizing step using an annular bracing assembly; limiting the axial movement of the movable end support; and substantially centralizing the mandrel intermediate the packers so as to resist buckling of the mandrel.

Each packer may include a first expandable tubular element having a pair of ends, and a first pair of annular end supports for securing the respective ends of the first tubular element about the mandrel. Preferably, one of the end supports is movable and the other end support is fixed with respect to the mandrel. The deformation-restricting step is achieved in these embodiments using an annular bracing assembly pivotally-connected at one of its ends to one of the end supports for reinforcing the first tubular element upon pressurization and expansion thereof.

In particular embodiments, the method further includes the step of actively retracting the packers using ambient borehole pressure. Accordingly, each packer may include an expandable tubular element having a pair of ends, and a pair of annular end supports for securing the respective ends of the tubular element about the mandrel. One of the end supports is movable and the other end support is fixed with respect to the mandrel. The movable end support is equipped with an inwardly-facing surface area that exceeds its outwardly-facing surface area. Borehole fluid pressure imposes a net force that moves the movable end support, outwardly when the first tubular element is depressurized and contracted, thereby actively retracting the packer using the borehole fluid pressure.

The centralizing step may also be achieved using a centralizer that employs a plurality of hinged arms.

Other aspects and advantages of the invention will be apparent from the following description and the appended claims.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 2:
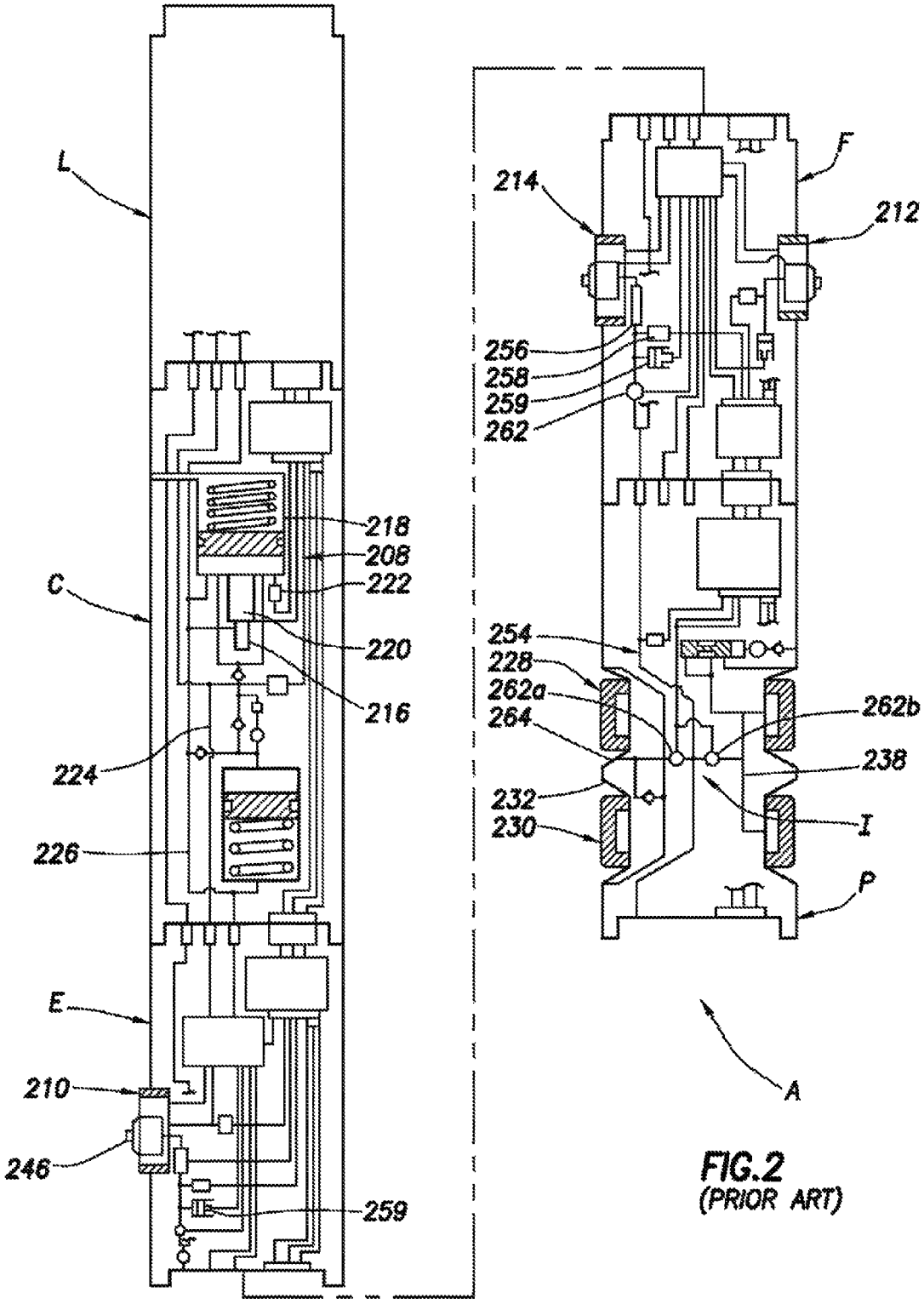
FIG.2 (PRIOR ART)
FIGS. 2-3 shown schematic representations of a known wireline-conveyed downhole tool with which the present invention may be utilized to advantage.
Figure 3:
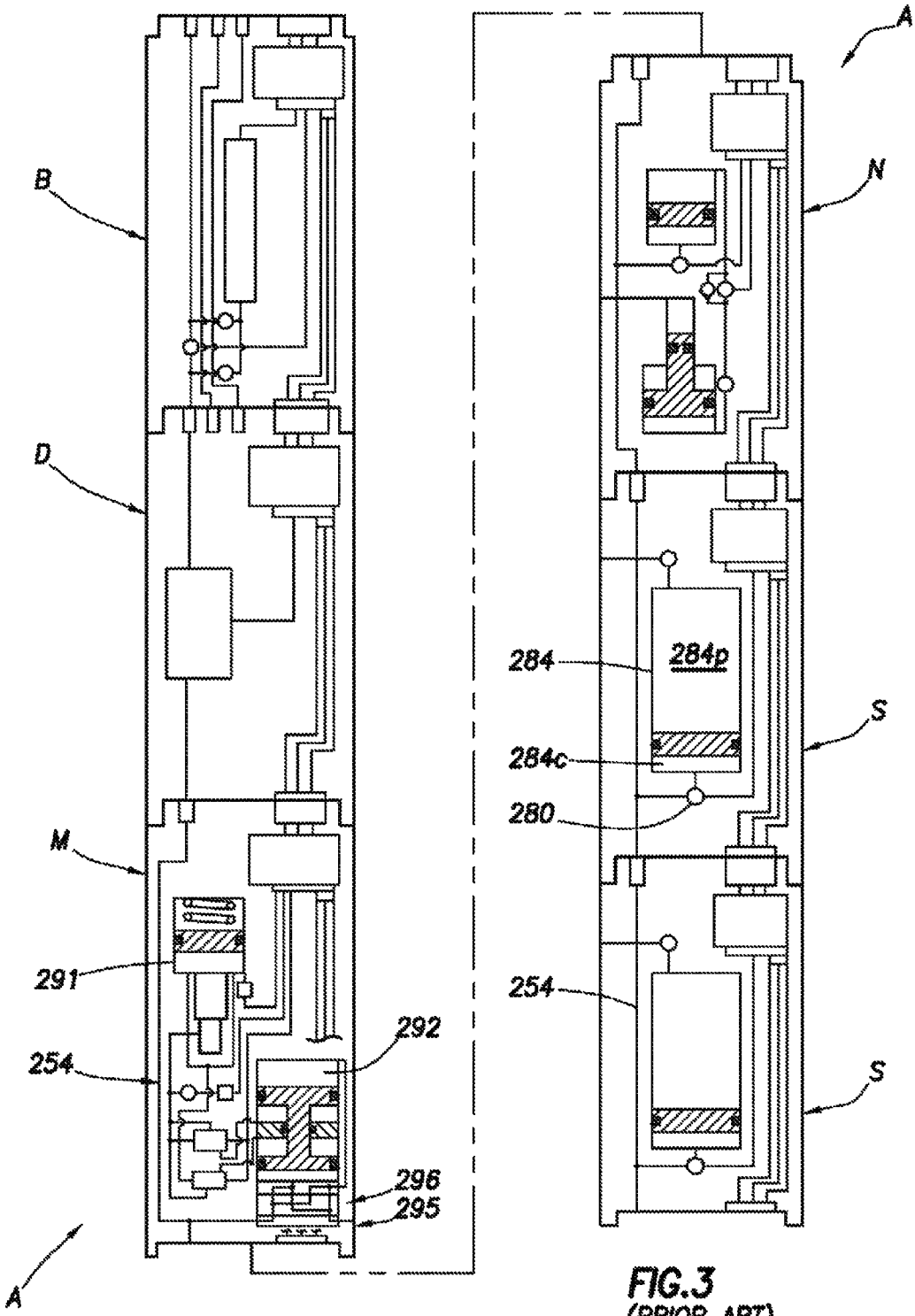
FIG.3 (PRIOR ART)

Turning now to prior art FIGS. 2 and 3, an example of an apparatus with which the present invention may be used to advantage is illustrated schematically. Other downhole tools, such as drilling, coiled tubing, completions or other tools may optionally be used. The apparatus A is a downhole tool that can be lowered into the well bore (not shown) by a wireline (not shown) for the purpose of conducting formation properly tests. Apparatus A is described in greater detail in U.S. Pat. Nos. 4,860,581 and 4,936,139 assigned to Schlumberger. For information purposes, some details of the apparatus are described herein. The wireline connections to tool A as well as power supply and communications-related electronics are not illustrated for the purpose of clarity. The power and communication lines that extend throughout the length of the tool are generally shown at 208. These power supply and communication components are known to those skilled in the art and have been in commercial use in the past. This type of control equipment would normally be installed at the uppermost end of the tool adjacent the wireline connection to the tool with electrical lines running through the tool to the various components.

As shown in the embodiment of FIG. 2, the apparatus A has a hydraulic power module C, a packer module P, and a probe module E. Probe module E is shown with one probe assembly 210 which may be used for permeability tests or fluid sampling. When using the tool to determine anisotropic permeability and the vertical reservoir structure according to known techniques, a multiprobe module F can be added to probe module E, as shown in FIG. 2. Multiprobe module F has sink probe assemblies 212 and 214. Other modules L, B, D may also be used.

The hydraulic power module C includes pump 216, reservoir 218, and motor 220 to control, the operation of the pump 216. Low oil switch 222 also forms part of the control system and is used in regulating the operation of the pomp 216.

The hydraulic fluid line 224 is connected to the discharge of the pump 216 and runs through hydraulic power module C and into adjacent modules for use as a hydraulic power source. In the embodiment shown in FIG. 2, the hydraulic fluid line 224 extends through the hydraulic power module C into the probe modules E and/or F depending upon which configuration is used. The hydraulic loop is closed by virtue of the hydraulic fluid return line 226, which in FIG. 2 extends from the probe module E back to the hydraulic power module C where it terminates at the reservoir 218.

The pump-out module M, seen in FIG. 3, can be used to dispose of unwanted samples by virtue of pumping fluid through the flow line 254 into the borehole, or may be used to pump fluids from the borehole into the flow line 254 to inflate the dual inflatable packers (also known as straddle packers) 228 and 230. Furthermore, pump-out module M may be used to draw formation fluid from the wellbore via the probe module E or F, and then pump the formation fluid into the sample chamber module S against a buffer fluid therein. The reciprocating pump 292, energized by hydraulic fluid from the pomp 291, can be aligned to draw from the flow line 254 and dispose of the unwanted sample though flow line 295, or it may be aligned to pump fluid from the borehole (via flow line 295) to flow line 254. The pumpout module can also be configured where flowline 295 connects to the flow line 254 such that fluid may be drawn from the downstream portion of flowline 254 and pumped upstream or vice versa.

The pump out module M has the necessary control devices to regulate the piston pump 292 and align the fluid line 254 with fluid line 295 to accomplish the pump out procedure. It should be noted here that piston pump 292 can be used to pump samples into the sample chamber module(s) S, including overpressuring such samples as desired, as well as to pump samples out of sample chamber module(s) S using the pump-out module M. The pump-out module M may also be used to accomplish constant pressure or constant rate injection if necessary. With sufficient power, the pump out module M may be used to inject fluid at high enough rates so as to enable creation of microfractures for stress measurement of the formation.

Alternatively, the dual inflatable packers 228 and 230 shown in FIG. 2 can be inflated and deflated with borehole fluid using the piston pump 292. As can be readily seen, selective actuation of the pump-out module M to activate the piston pump 292, combined with selective operation of the control valve 296 and inflation and deflation of the valves I, can result in selective inflation or deflation of the packers 228 and 230. Packers 228 and 230 are mounted to outer periphery 232 of the apparatus A, and employ bodies or elements that are typically constructed of a resilient material compatible with wellbore fluids and temperatures. The packer elements are mounted such that the packers 228 and 230 have a cavity therein. When the piston pump 292 is operational and the inflation valves I are properly set, fluid from the flow line 254 passes through the inflation/deflation valves I, and through the flow line 238 to the packers 228 and 230.

Having inflated the packers 228 and 230 and/or set the probe 210 and/or the probes 212 and 214, the fluid withdrawal testing of the formation can begin. The sample flow line 254 extends from the probe 246 in the probe module E down to the outer periphery 232 at a point between the packers 228 and 230 through the adjacent modules and into the sample modules S. The vertical probe 210 and the sink probe 214 thus admit formation fluids into the sample flow line 254 via one or more of a resistivity measurement cell 256, a pressure measurement device 258, and a pretest mechanism 259, according to the desired configuration. Also, the flowline 264 allows entry of formation fluids into the sample flowline 254. When using the module E, or multiple modules E and F, the isolation valve 262 is mounted downstream of the resistivity sensor 256. In the closed position, the isolation valve 262 limits the internal flow line volume, improving the accuracy of dynamic measurements made by the pressure gauge 258. After initial pressure tests are made, the isolation valve 262 can be opened to allow flow into the other modules via the flowline 254.

Figure 4A:
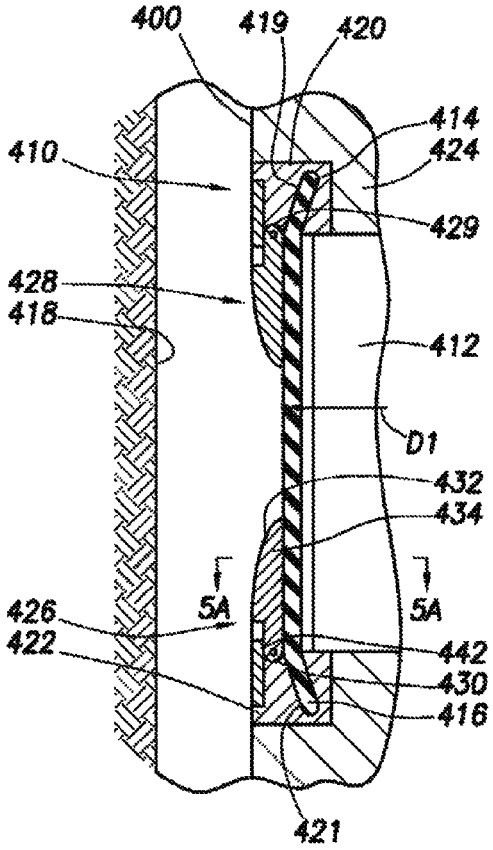
FIG. 4A shows a downhole tool equipped with an inflatable packer and an annular bracing assembly.
Figure 4B:
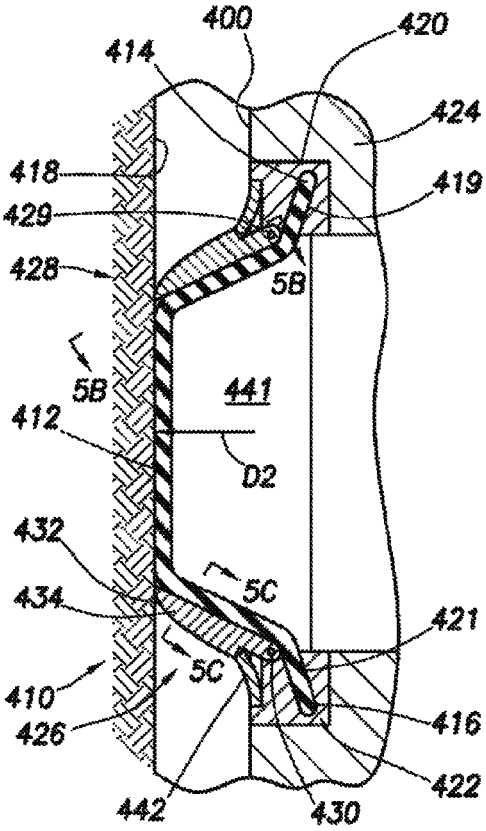
FIG. 4B shows the downhole tool of FIG. 4A with the packer inflated and the annular bracing assembly expanded to resist extrusion of the packer.

The sample chamber module S can then be employed to collect a sample of the fluid delivered via the flow line 254 and regulated by the flow control module N, which is beneficial but not necessary for fluid sampling. With reference first to the upper sample chamber module S in FIG. 3, a valve 280 is opened and the valves 262, 262A and 262B are held closed, thus directing the formation fluid in the flow line 254 into a sample collecting cavity 284C in the chamber 284 of sample chamber module S, after which the valve 280 is closed to isolate the sample. The chamber 284 has a sample collecting cavity 284C and a pressurization/buffer cavity 284*p*. The tool can then be moved to a different location and the process repeated. Particular aspects or the present invention having utility with downhole tools, such as tool A described above, will now be described. FIGS. 4A-4B show a portion of a downhole tool 400 equipped with an inflatable packer assembly 410. Although such packer assemblies are typically provided with pairs of dual packer elements, only a single packer element 412 with a corresponding bracing assembly 426 is shown here for simplicity and clarity. Those skilled in the art will appreciate that single packer elements have independent utility in certain applications apart from dual-packer configurations. FIG. 4A shows the packer element 412 being deflated for running into and out of the borehole 418, while FIG. 4B shows the packer element 412 being inflated and the annular bracing assembly 426 expanded to resist extrusion of the packer element.

The inflatable packer assembly 410 includes the expandable tubular packer element 412 having a pair of ends 414, 416, and a first pair of annular end supports 420, 422 having respective annul uses 419, 421 for securing the respective ends 414, 416 of the first tubular packer element 412 about a mandrel 424 at least partially disposed within the first tubular packer element 412. The lower end support 422 is movable and the upper end support 420 is fixed with respect to the mandrel 424. Alternatively, both of the upper and lower end supports may be fixed (not shown) given that the packer element 412 is suitably constructed to allow for additional elastic deformation.

The first annular bracing assembly 426 is deployable from the lower end support 422 by being pivotally-connected at one of its ends 430 to the lower end support 422 for reinforcing the first tubular packer element 412 upon pressurization and expansion (i.e., inflation) thereof. Those having ordinary skill in the art will appreciate that other means of deployment (e.g., sliding translatory movement) may be employed to advantage. The annular bracing assembly 426 functions as an external mechanical support to the tubular packer element 412, and effectively bridges the gap between the end support 422 (which is metallic) and the borehole wall 418. This works to relieve the flexible tubular packer element 412 from having to provide the mechanical strength to support itself (e.g., via reinforcing inserts such as slats). The bracing assembly provides support to assist the tubular packer element 412 in forming a seal between the borehole wail 418 and the packer mandrel 424.

The first annular bracing assembly 426 is expandable at its end 432 opposite the pivotally connected end 430, whereby the assembly 426 becomes frustoconically-shaped upon inflation of the tubular packer element 412 (see FIG. 4B). The packer assembly may include a second annular bracing assembly 428 pivotally-connected at its end 429 to the upper end support 420 for further reinforcing the first tubular packer element upon pressurization and expansion (i.e., inflation) thereof. Although this embodiment is shown to employ two annular bracing assemblies 426, 428, it will be appreciated by those having ordinary skill in the art that one such assembly may be employed to advantage. In the latter case, the one annular bracing assembly will typically be placed on the low-pressure side of the tubular packer element 412 (e.g., the side exposed to reduced pressure in a fluid sampling dual, packer assembly), since that side is more likely to undergo extrusion and substantial deformation than the high pressure side (i.e., the side exposed to ambient borehole pressure) of the tubular packer element.

Figure 5A:
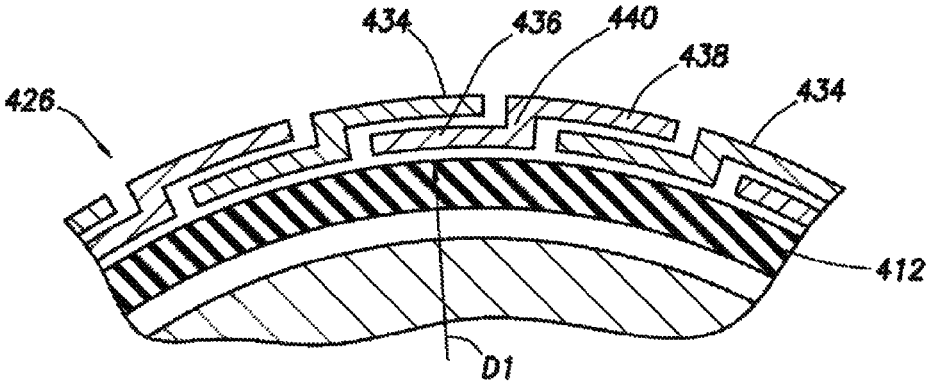
FIG. 5A shows a partial sectional view according to section line 5A-5A in FIG. 4A.

Various embodiments of the annular bracing assembly may employ a plurality of fingers or slats arranged in an annular configuration and pivotally connected at at least one of its ends to either the movable end support and/or the fixed end support. FIG. 5A shows a partial sectional view according to section line 5A-5A in FIG. 4A of the plurality of slats 434 included in the first annular bracing assembly 426. The slats 434 are shown to employ a stepped cross-sectional design wherein two plate-like sections 436, 438, each slightly curved so as to follow the curved perimeter of the tubular packer element 412, and a radially-oriented neck 440 connects the plate-lie sections 436, 438. This design permits adjacent slats 434 to easily overlay one another to collectively define the annular bracing assembly 426. Those having ordinary skill in the art will appreciate, however, that other simpler cross-sectional designs (e.g., single plate-like section) may be employed to advantage.

Figure 1A:
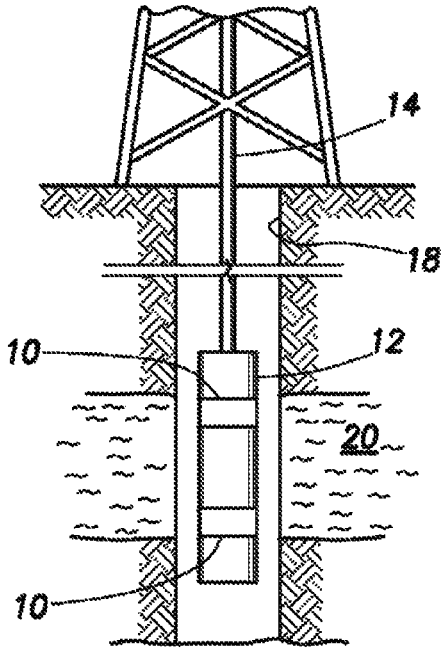
FIG. 1A (PRIOR ART)
FIG. 1A is a prior art schematic representation of a wireline-conveyed downhole tool equipped with a pair of inflatable packers.
Figure 1B:
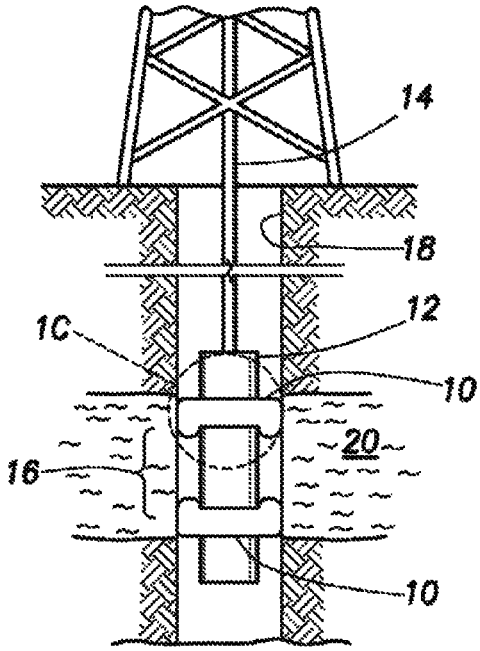
FIG. 1B (PRIOR ART)
FIG. 1B shows the downhole tool of FIG. 1A with the packers inflated and undergoing extrusion on the respective low-pressure sides.
Figure 1C:
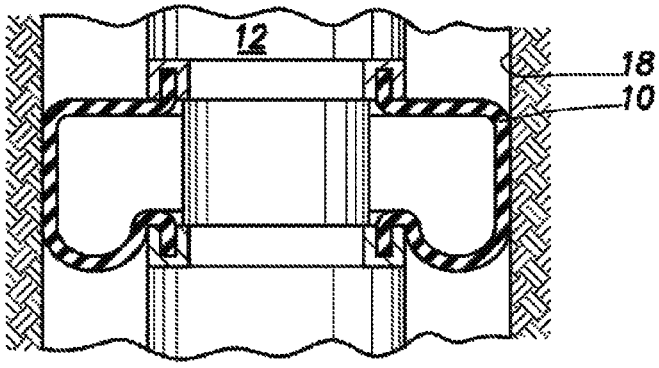
FIG. 1C (PRIOR ART)
FIG. 1C shows a detailed representation of the upper packer of FIG. 1B.
Figure 5B:
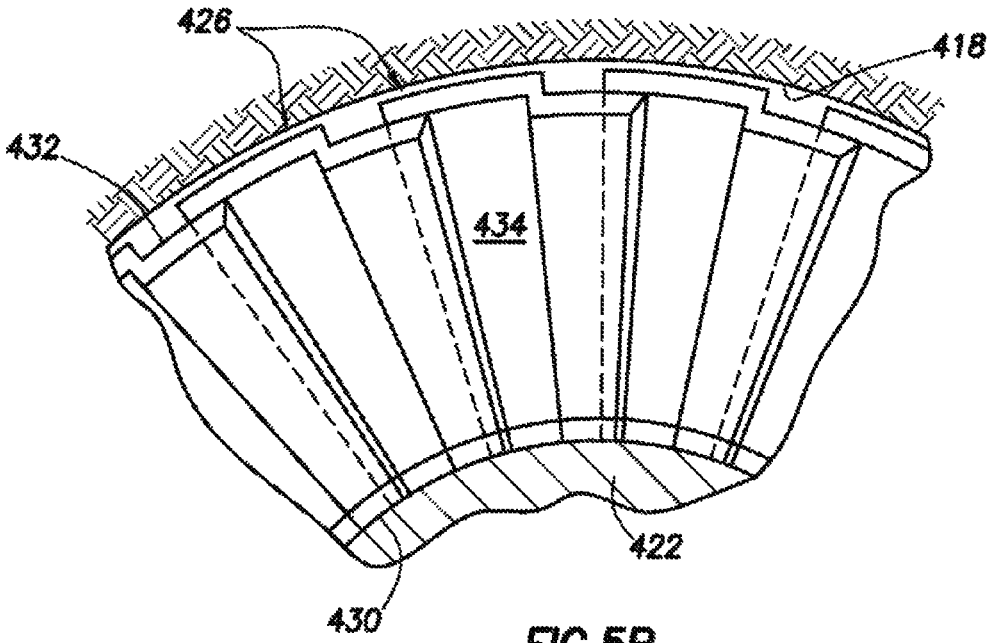
FIG. 5B shows a partial sectional view according to section line 5B-5B in FIG. 4B.
Figure 5C:
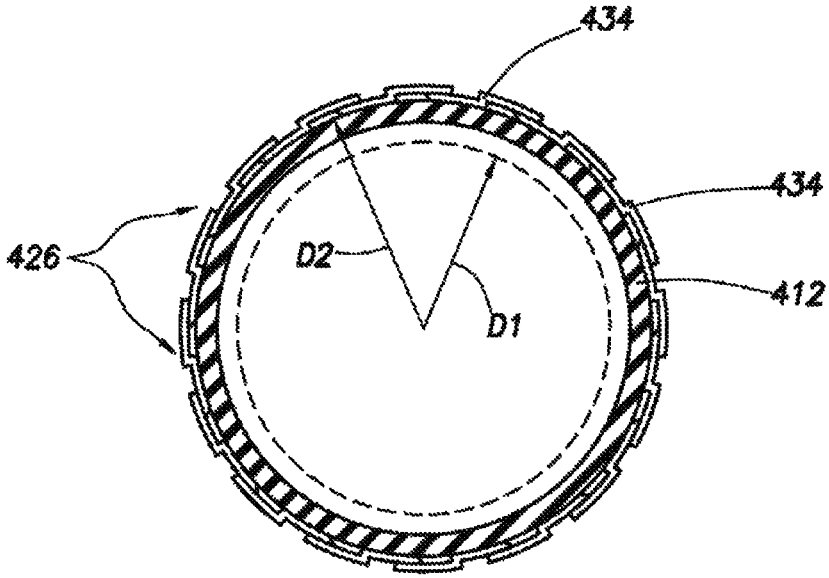
FIG. 5C shows a partial sectional view according to section line 5C-5C in FIG. 4B.

FIG. 5B shows a partial sectional view of the annular bracing assembly 426 in an inflated position according to section line 5B-5B in FIG. 4B. FIG. 5C similarly shows a partial sectional view of the annular bracing assembly 426 in an inflated position according to section line 5C-5C in FIG. 4B. Thus, as shown in FIG. 4B, it is preferred that each of the slats 434 has a width that increases from its pivotally connected end 430 to its other expanded end 432, although such a width profile is not essential. Additionally, the overlaying configuration of the slats is designed to accommodate expansion of the ends 432 into engagement with the borehole wail 418 while continuously maintaining at least partial overlap between adjacent slats 434. This ensures that the tabular packer element 412 is fully supported across the area thereof that might otherwise undergo extrusion and plastic deformation, as shown in FIGS. 1B-1C.

Thus, inflation of the tubular packer element 412 expands the outer diameter of the element from a diameter $D_1$ to a diameter $D_2$, as indicated in FIGS. 4A-4B, 5A and (particularly) 5C. Such inflation occurs by pumping ambient borehole fluid into the cavity 441 of the tubular packer element 412 in a manner that is well known to those of ordinary skill in the art, and as described to some extent with regard to downhole tool A of FIGS. 2-3 above. The tubular packer element 412 is deflated by discharging the borehole fluid within the cavity 441 back into the borehole, in a manner that is also well known in the art.

One or more spring braces 442 each having an appropriate spring stiffness are employed to assist in restoring the annular bracing assembly and the tubular packer element 412 back to their original running positions of FIG. 4A when the tubular packer element 412 is deflated. Each spring brace 442 has ends connected to one or more slats 434 and the lower end support 422, and upon inflation of the tubular packer element 412 (see FIG. 4B) are flexed to a position where the stiffness of the spring brace urges the packer element 412 to its retracted position.

Figure 6B:
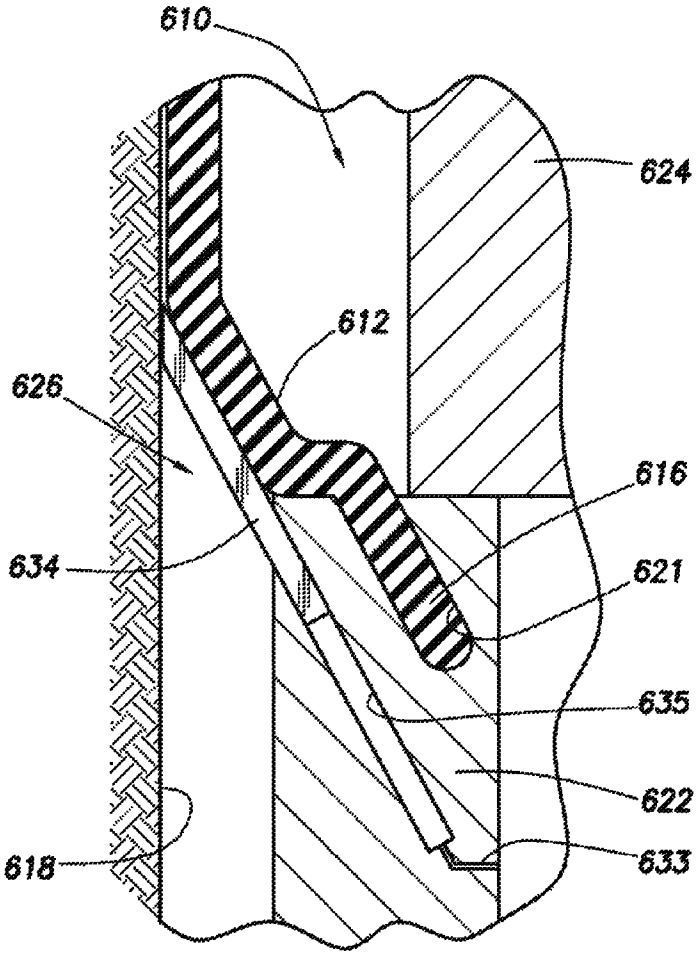
FIG. 6B shows the packer of FIG. 6A inflated and the first alternative annular bracing assembly expanded to resist extrusion of the packer.
Figure 6A:
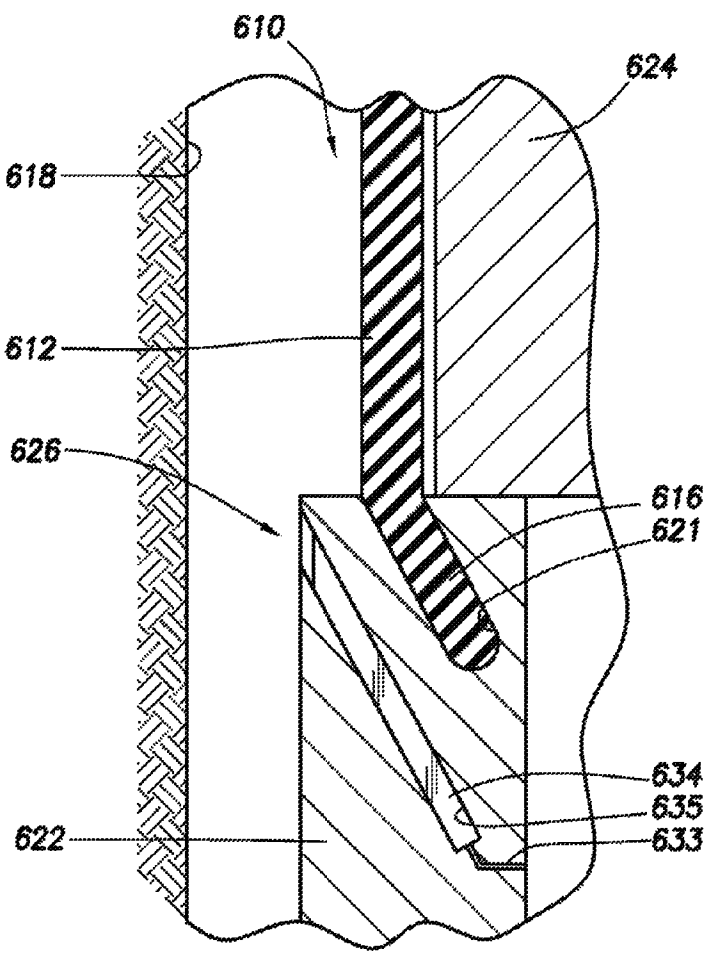
FIG. 6A shows a portion of an inflatable packer and a first alternative annular bracing assembly.

FIGS. 6A-6B show a portion of an inflatable packer assembly 610 positioned in borehole 618 and sequentially deploying an alternative annular bracing assembly 626. FIG. 6A depicts the annular bracing assembly In the retracted position, and FIG. 6B depicts the annular bracing assembly in the extended position. In similar fashion to the embodiment shown in FIGS. 4A-4B, a tubular packer element 612 has a pair of ends (only end 616 shown), and a first pair of annular end supports (only end support 622 shown) having respective annuluses (only annulus 621 shown) for securing the respective ends of the first tubular packer element 612 about a mandrel 624 at least partially disposed within the first tubular packer element 612. The lower end support 622 is movable and the upper end support (not shown) is fixed with respect to the mandrel 624.

The packer assembly 610 operates differently from the packer assembly 410 described above, particularly in the manner in which the annular bracing assembly 626 is deployed from the end support 622. Thus, the annular bracing assembly comprises a plurality of slats 634 disposed for sliding translatory movement within a plurality of respective channels 635 formed about the end support 622. Hydraulic fluid is provided via one or more flow line(s) 633 from the mandrel 624, in a manner that is known in the art (e.g., under manipulation of pumps and valves carried within or operatively connected to the mandrel 624), so as to induce concerted movement of the slats 634 between the retracted, running position of FIG. 6A and the extended, bracing position of FIG. 6B. The channels 635 are preferably fluidly interconnected so as to be pressurized and de-pressurized together.

Figure 7B:
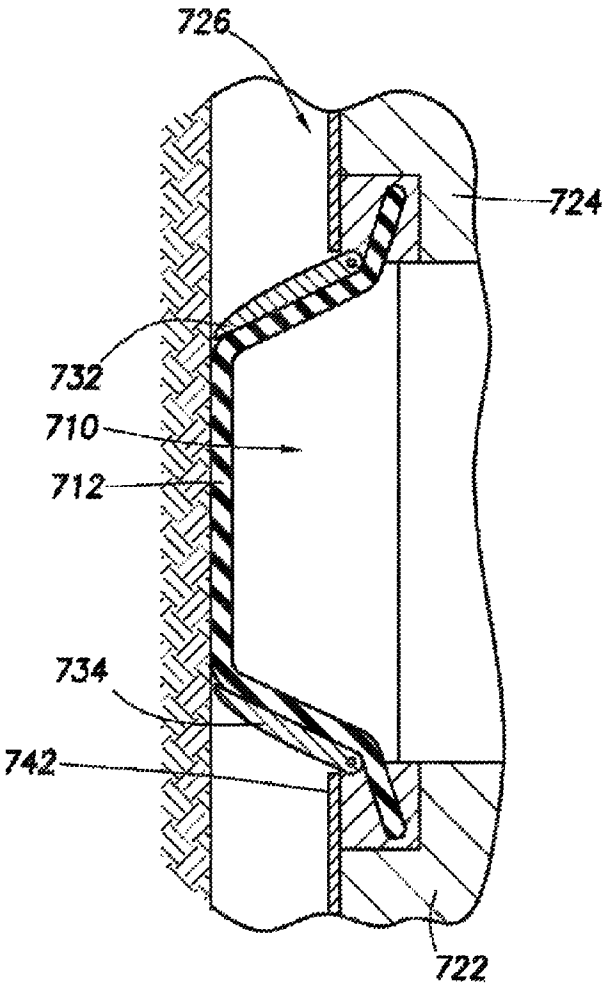
FIG. 7B shows the packer of FIG. 7A inflated and the second alternative annular bracing assembly expanded to resist extrusion of the packer.
Figure 7A:
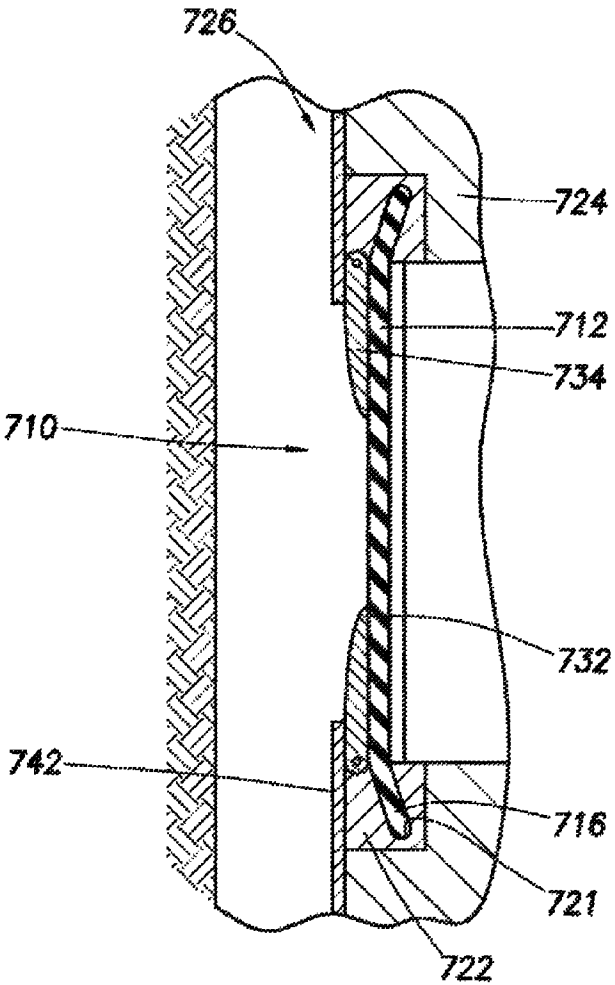
FIG. 7A shows a portion of an inflatable packer and a second alternative annular bracing assembly.

FIGS. 7A-7B show a portion of an inflatable packer assembly 710 sequentially deploying an alternative annular bracing assembly 726. FIG. 7A depicts the annular bracing assembly in the retracted position, and FIG. 7B depicts the annular bracing assembly in the extended position. In similar fashion to the embodiment shown in FIGS. 4A-4B, a tubular packer element 712 has a pair of ends (only 716 is shown), and a first pair of annular end supports (only end support 722 is shown) having respective annuluses (only annulus 721 is shown) for securing the respective ends of the first tubular packer element 712 about a mandrel 724 at least partially disposed within the first tubular packer element 712. The lower end support 722 is movable and the upper end support (not shown) is fixed with respect to the mandrel 724.

The packer assembly 710 operates similarly to the packer assembly 410 described above, except for the manner in which the packer assembly 710 is retracted to its running position upon deflation of the tubular packer element 712. In particular, the spring brace 442 of the previously-described embodiment is replaced with a sliding sleeve 742 that is moved downwardly (e.g., under manipulation of pumps and valves carried within or operatively connected to the mandrel 724) to a lower position to permit expansion of the tubular packer element 712 and the outer ends 732 of the slats 734 that substantially make up the annular bracing assembly 726, which is shown in FIG. 7B. Upon deflation of the tubular packer element 712, the sleeve 742 is moved upwardly to assist in the retraction of the tubular packer element 712 and annular bracing assembly 726.

Figure 8B:
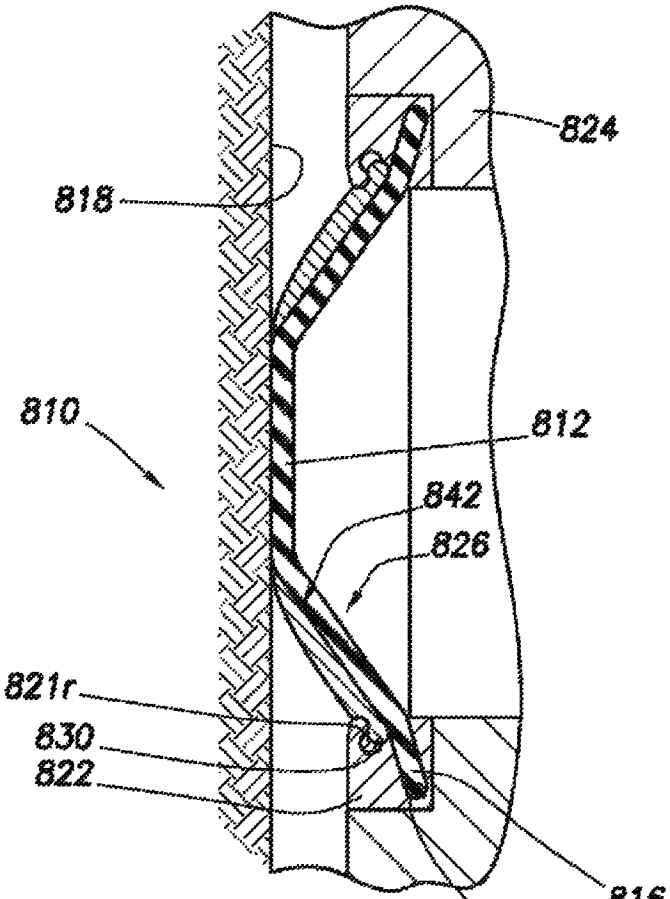
FIG. 8B shows the packer of FIG. 8A inflated and the third alternative annular bracing assembly expanded to resist extrusion of the packer.
Figure 8A:
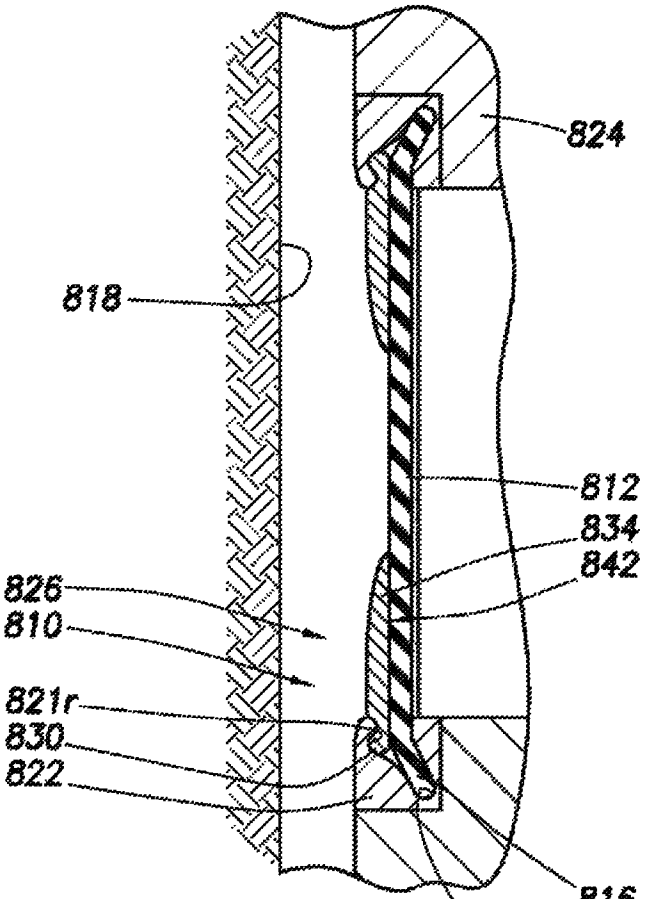
FIG. 8A shows a portion of an inflatable packer and a third alternative annular bracing assembly.

FIGS. 8A-8B show a portion of an inflatable packer assembly 810 sequentially deploying a further alternative annular bracing assembly 826. FIG. 8A depicts that packer assembly 810 in the retracted position, and FIG. 8B shows the packer assembly 810 in the extended position adjacent borehole wall 818. In similar fashion to the embodiment shown in FIGS. 4A-4B and 7A-7B, a tubular packer element 812 has a pair of ends (only end 816 is shown), and a first pair of annular end supports (only end support 822 is shown) having respective annuluses (only annulus 821 is shown) for securing the respective ends of the first tubular packer element 812 about a mandrel 824 at least partially disposed within the first tubular packer element 812. The lower end support 822 is movable and the upper end support 820 is fixed with respect to tire mandrel 824.

The packer assembly 810 operates similarly to the packer assemblies 410 and 710 described above, except for the manner in which the end 830 of the annular bracing assembly is pivotally connected to the lower end support 822, and the manner in which the packer assembly 810 is retracted to its running position upon deflation of the tubular packer element 812. Thus, the end 830 of the annular bracing assembly 826 defines a flange that is closely fitted within a recess 821*r* of the annulus 821 of the lower end support 822.

Additionally, the spring brace 442 and sleeve 742 of the previously-described embodiments are replaced with a bonding agent 842 applied between tubular packer element 812 and the slats 834 that substantially make up the annular bracing assembly 826. Accordingly, the slats 834 follow the tubular packer element 812 to the retracted running position of FIG. 8A upon deflation. It will be recognized by those having ordinary skill in the art that the bonding of the slats 834 to the tubular packer element 812 via the bonding agent 842 effects a particular tensile force in the tubular packer element 812 upon inflation thereof that tends to bias the element back to its running position, thereby assisting in the retraction of the packer assembly 810 during deflation thereof.

While the packer assembly embodiments of FIGS. 4A-8B are each illustrated as having only one tubular packer element, the typical configuration for such packer assemblies employs dual packer elements spaced apart along a mandrel. Accordingly, the packer assembly may further include a second expandable tubular packer element (not shown in these figures) having a pair of ends, and a second pair of annular end supports (not shown in these figures) for securing the respective ends of the second tubular packer element about the mandrel. Typically, one of the second pair of end supports is movable and die other end support, is fixed with respect to the mandrel. The first and second pair of end supports cooperate to define an axial separation distance (like the separation distance 16 of FIG. 1B) between the first and second tabular packer elements. A second annular bracing assembly is pivotally-connected at one of its ends to one of the second pair of end supports for reinforcing the second tubular packer element upon pressurization and expansion thereof.

Figure 9:
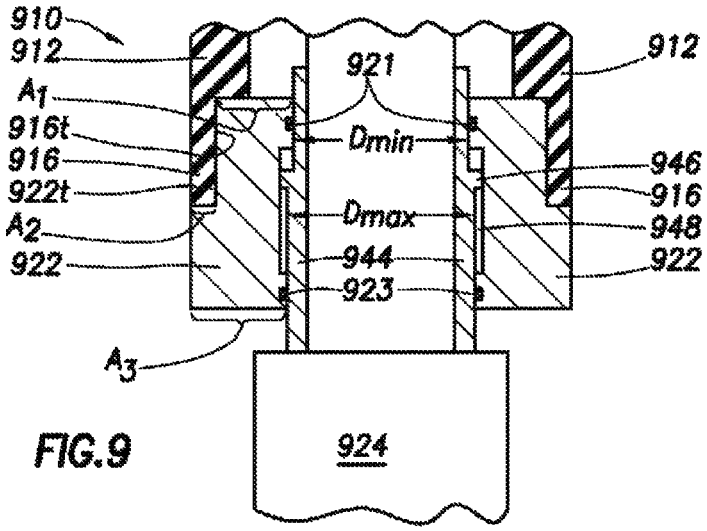
FIG. 9 shows a retraction assembly.

FIG. 9 shows a packer retraction assembly 910. This retraction assembly would typically be employed in a dual inflatable packer configuration, such as those described herein, in which case FIG. 9 would represent the lower end portion of each packer element in the dual packer configuration. The inflatable packer assembly 910 includes an expandable tubular packer element 912 having a pair of ends (one numbered as 916), and a pair of annular end supports 922 (only the latter end being shown) for securing the respective ends of the tubular packer element 912 (e.g., via complementing threads 916*t* and 922*t*) about a mandrel 924 at least partially disposed within the first, tubular packer element 912. The lower end support 922 is movable and the upper end support (not shown) is fixed with respect to the mandrel 924. The movable end support 922 is equipped with an inwardly-facing surface area ($A_1$+$A_2$) that preferably exceeds its outwardly-feeing surface area $A_3$, whereby ambient borehole fluid pressure (which acts on these areas) imposes a net force that moves the movable end support outwardly (i.e., downwardly in the case of lower end support 922) when the tubular packer element 912 is depressurized and contracted (i.e., deflated).

FIG. 9 shows the lower end support 922 in its lower position, prior to sliding upwardly for packer inflation. As mentioned, the retracting force (downwardly) on the lower end support 922 results from the difference between $D_{min}$ and $D_{max}$, and the corresponding difference between the inwardly-facing surface area ($A_1$+$A_2$) and outwardly-facing surface area $A_3$. Thus, with ambient borehole fluid providing hydrostatic pressure around packer assembly 910, a retracting force will typically be created. This retracting force preferably acts on the lower end support 922 at all times during borehole operations to retract the packer element 9.12 under low hydrostatic environments. In addition, the retracting force preferably does not hinder packer inflation in high hydrostatic environments.

In the embodiment of FIG. 9, the movable end support 922 is disposed for axial movement about a sleeve 944 fixed to the mandrel 924. The sleeve 944 has a stepped radius that defines a minimum diameter $D_{min}$ and a maximum diameter $D_{max}$ which, in turn, correspond to the inwardly-facing surface area ($A_1$+$A_2$) and outwardly-facing surface area $A_3$ of the movable end support 922. The movable end support 922 and sleeve 944 cooperate to form a low-pressure chamber 948, which is charged to atmospheric pressure, near-vacuum, or other suitable low pressure, and is sealed by annular seals 921, 923 (e.g., high temperature O-rings). The low-pressure chamber 948 permits movement of the movable end support 922 relative to the sleeve 944 under ambient borehole fluid pressure.

The sleeve 944 is preferably equipped with a mechanical stop member 946 disposed in the sealed low-pressure chamber 948 for limiting the axial movement of the movable end support 922 along the sleeve. The stop member 946 prevents the bottom part of the lower end support 922 from ascending too much and losing the bottom sealing engagement with the sleeve 944 upon inflation of the tubular packer element 912. Additionally, by limiting the upward movement of the lower end support 922, the stop member 946 reduces the deformation experienced by the tubular packer element 912 near its lower end 916 where the bending radius is short and the stress concentrations are significant. The resulting (milder) deformation is intended to extend the useful life of the packer element 912 by avoiding the square-like transition zone that otherwise occurs in conventional inflatable packers when, e.g., the packer element bends near the movable end support. Additionally, limiting the upward movement of the lower end support 922 via the mechanical stop member 946 is designed to increase the tensile force developed in the packer element 912 and inhibit plastic deformation of the packer element or the metallic inserts therein (if used).

The stop member described herein provides independently utility within a packer assembly, and, accordingly, may be used independently of the packer retraction assembly. Additionally, the stop member need not be embodied by a hard stop mechanism, as shown by stop member 946, but instead may be compliant (e.g., including a spring component) so as to apply a more gradual limiting force over a longer axial displacement of a movable end support.

Figure 10A:
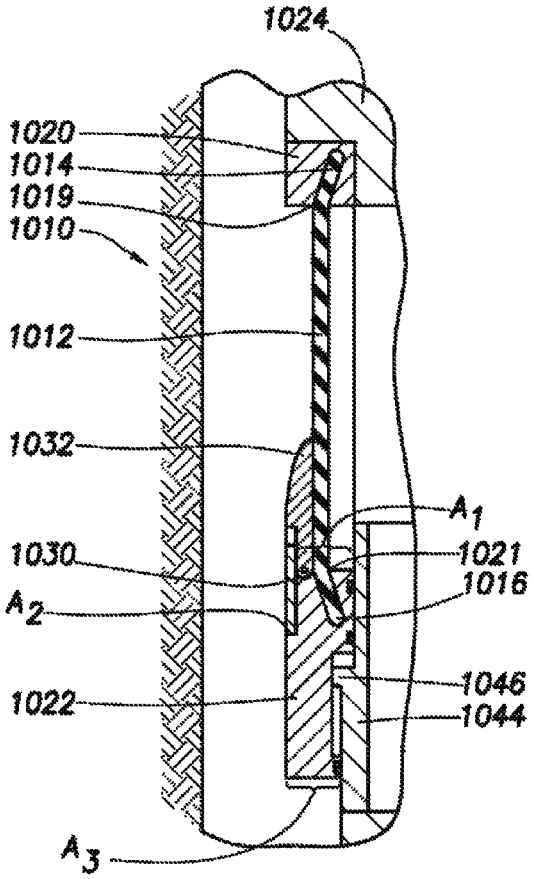
FIG. 10A shows the annular bracing assembly of FIGS. 4A-4B and the retraction assembly of FIG. 9 both applied to an inflatable packer.
Figure 10B:
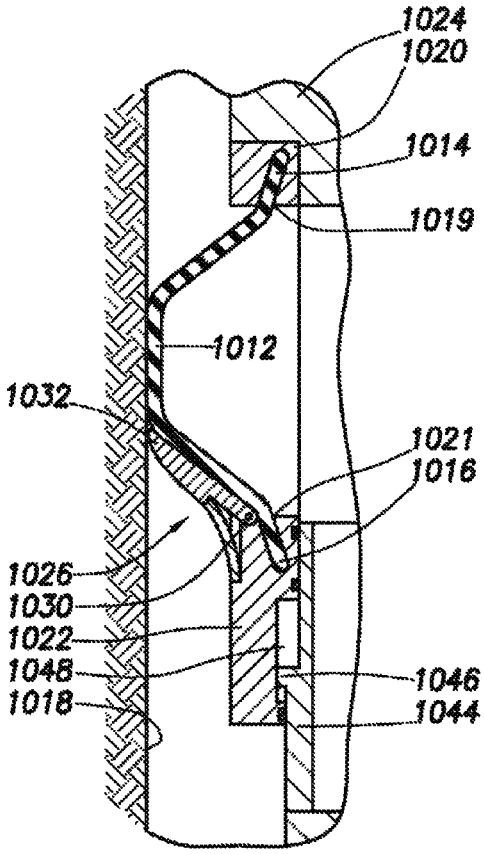
FIG. 10B shows the packer of FIG. 10A inflated and the annular bracing assembly expanded to resist extrusion of the packer.

FIGS. 10A-10B show the annular bracing assembly of FIGS. 4A-4B and the retraction assembly of FIG. 9 both applied to an inflatable packer assembly. FIG. 10A depicts the annular bracing assembly in the retracted position, and FIG. 10B depicts the annular bracing assembly in the extended position. Accordingly, an inflatable packer assembly 1010 includes an expandable tubular packer element 1012 having a pair of ends 1014, 1016, and a pair of annular end supports 1020, 1022 having respective annuluses 1019, 1021 for securing the respective ends of the tubular packer element 1012 about a mandrel 1024 at least partially disposed within the first tubular packer element 1012. The lower end support 1022 is movable and the upper end support 1020 is fixed with respect to the mandrel 1024.

The movable end support 1022 is equipped with an inwardly-facing surface area ($A_1$+$A_2$) that preferably exceeds its outwardly-facing surface area $A_3$, whereby ambient borehole fluid pressure (which acts on these areas) imposes a net force that moves the movable end support outwardly (i.e., downwardly in the case of lower end support 1022) when the tubular packer element 1012 is depressurized and contracted (i.e., deflated).

The movable end support 1022 moves axially about a sleeve 1044 fixed to the mandrel 1024. The sleeve 1044 has a stepped radius that defines minimum and maximum diameters which correspond to the inwardly-facing surface area ($A_1$+$A_2$) and outwardly-facing surface area $A_3$ of the movable end support 1022. A sealed low-pressure chamber 1048 permits movement of the movable end support 1022 relative to the sleeve 1044 under ambient borehole fluid pressure. The sleeve 1044 is preferably equipped with a mechanical stop member 1046 (essentially an expanded ring about its maximum diameter portion) that is disposed in the low-pressure chamber 1048 for limiting the axial movement of the movable end support 1022 along the sleeve. The stop member 1046 prevents the bottom part of the lower end support 1022 from ascending too much and losing the bottom sealing engagement with the sleeve 1044 upon inflation of the tubular packer element 1012.

An annular bracing assembly 1026 is pivotally-connected at one of its ends 1030 to the lower end support 1022 for reinforcing the first tubular packer element 1012 upon pressurization and expansion (i.e., inflation) thereof. The annular bracing assembly 1026 functions as a mechanical support to the tubular packer element 1012, and effectively bridges the gap between the end support 1022 (which is metallic) and the borehole wall 1018. This relieves the flexible tubular packer element 1012 from having to provide the mechanical strength to support itself (e.g., via reinforcing inserts), and allows the tubular packer element 1012 to function more reliably to affect the appropriate seal between the borehole wall 1018 and the packer mandrel 1024.

The annular bracing assembly 1026 is expandable at its end 1032 opposite the pivotally connected end 1030, whereby the assembly 1026 becomes frustoconically-shaped upon inflation of the tubular packer element 1012 (see FIG. 10B). Although this embodiment is shown to employ one annular bracing assembly 1026, it will be appreciated by those having ordinary skill, in the art that, another such bracing assembly may be employed at the upper end support 1020 to advantage.

Figure 11:
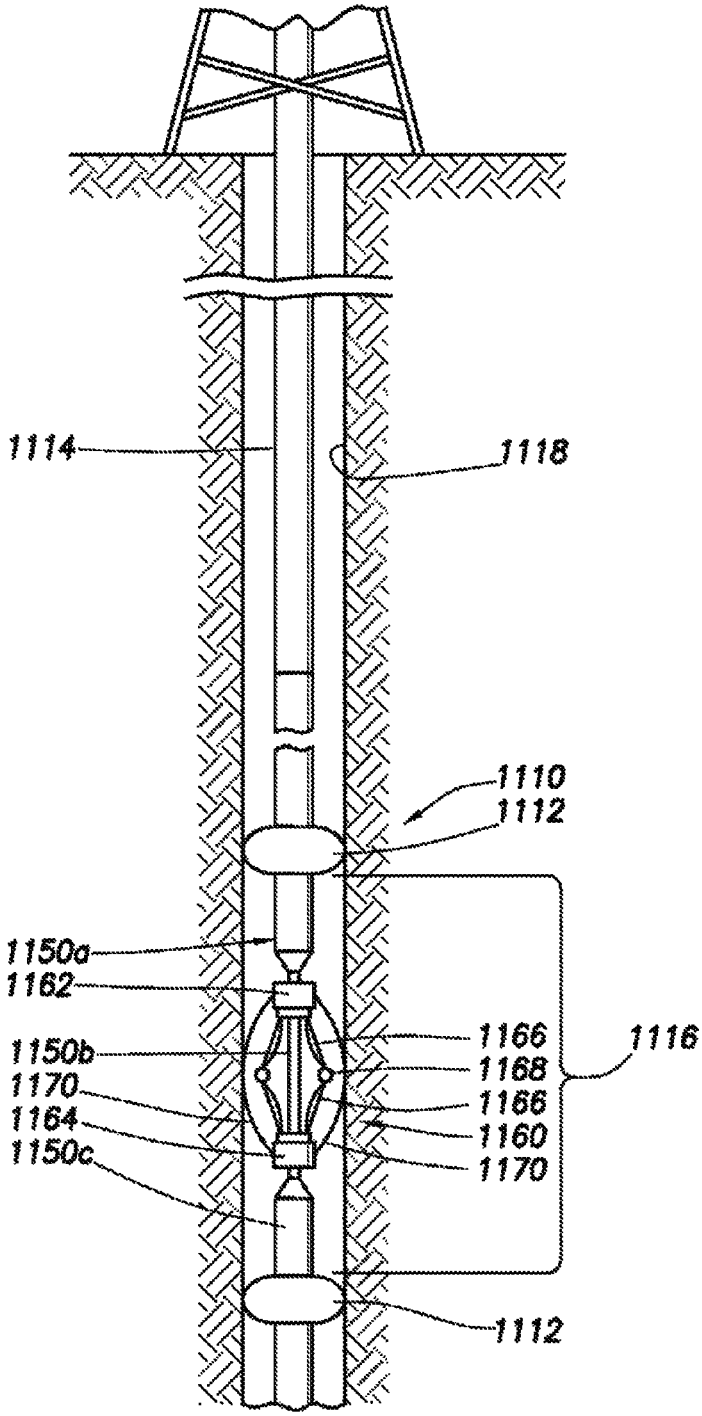
FIG. 11 shows a wireline tool having a dual packer assembly equipped with a centralizer for resisting buckling of the portion of the tool intermediate the packers.

FIG. 11 shows a drilling tool 1110 having a dual packer assembly equipped with a centralizer 1160 for resisting buckling of the portion of the tool intermediate the packers. Thus, the drilling tool 1110, which is defined by a plurality of interconnected mandrels 1150*a*, 1105*b*, and 1150*c*, is shown advanced by a drill string 1114 into a borehole defined by a borehole wall 1118. The tool is adapted for acquiring formation fluid samples within a portion 1116 of the borehole wall 1118 isolated by dual inflatable packer elements 1112.

An expandable centralizer 1160 is carried by the mandrel 1150*b* in the axial separation distance intermediate the first and second packers 1110 for resisting buckling of the mandrel during fluid sampling operations. The mandrel 1150*b* represents at least a portion of the so-called "spacer string" between the packer elements 1112, which provides the desired axial separation distance between the packer elements. Accordingly, the centralizes 1160 serves as an element of the spacer string. The centralizer 1160 includes a pair of supports 1162, 1164 carried along the mandrel 1150*a*, with at least one of the supports being axially-movable along the mandrel. The centralizer of these embodiments further includes a plurality of (preferably at least three) pairs of hinged arms 1166. The arms of each pair have first ends pivotally connected to the respective supports 1162, 1164 and second ends pivotally connected to each other at a pivotal joint 1168.

An actuator (not shown) is carried by one of the interconnected mandrels 1150*a/b/c* for inducing axial movement of each movable support (among supports 1162, 1164) such that the pivotally-connected second ends 1168 of each pair of arms is moved radially outwardly to exert a force on the borehole wall 1118 that substantially centers the mandrel in the borehole.

In open hole (i.e., uncased) sampling operations, the centralizer 1160 preferably further includes a plurality of spring blades 1170 each having ends pivotally connected to the respective supports 1162, 1164 so as to position the spring blades 1170 between the respective pairs of hinged arms 1166 and the borehole wall 1118. The spring blades 1170 and hinged arms 1166 cooperate to exert forces on the borehole wall that substantially centers the mandrel (preferably all three mandrels 1150*a/b/c*) in the borehole. Other aspects of the centralizer are known to those having ordinary skill in the art, e.g., as evidenced by the teachings of U.S. Pat. No. 5,358,039—although such centralizers are not believed to have been previously applied to packer assemblies as described herein.

Figure 12:
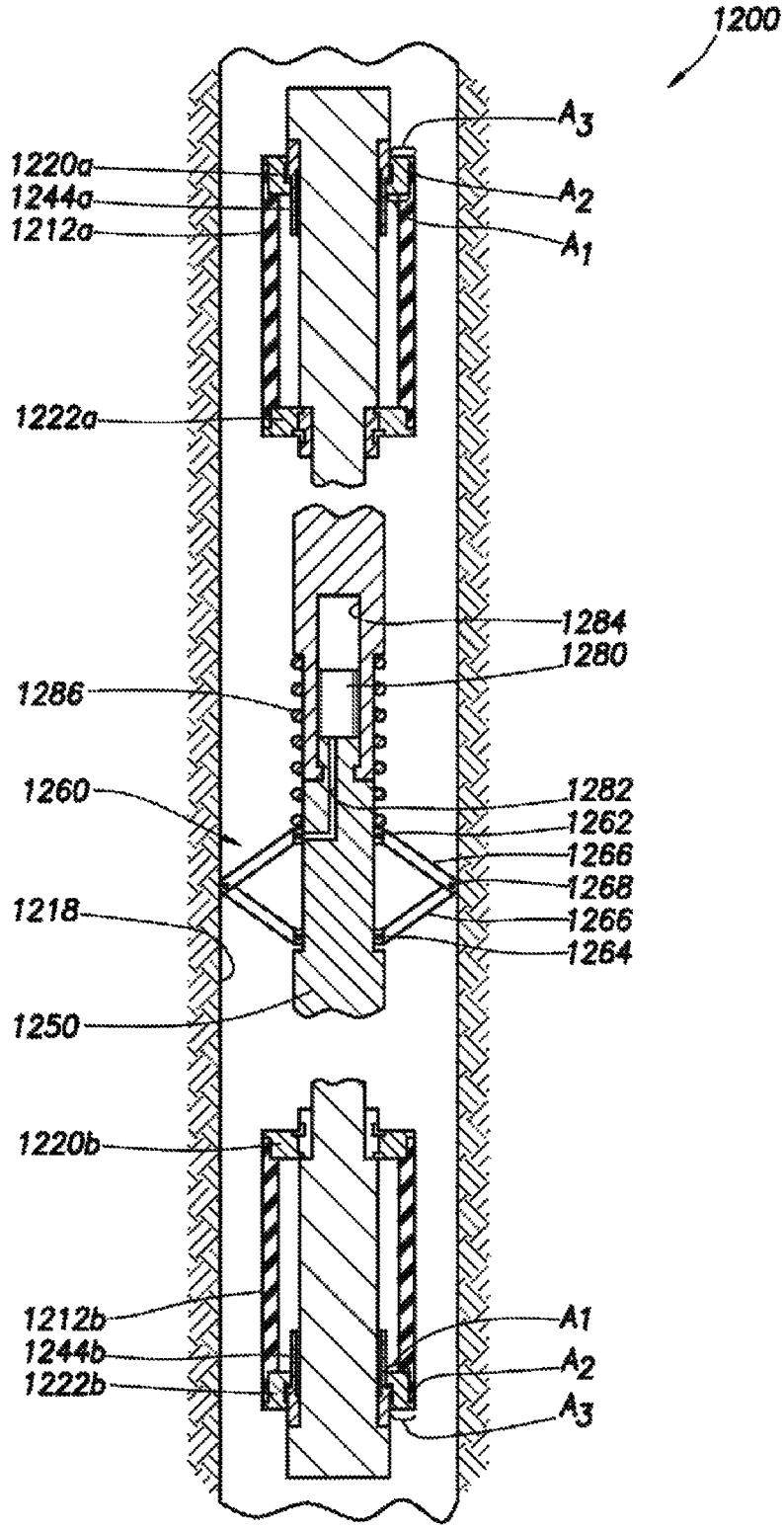
FIG. 12 shows a downhole tool equipped with a pair of inflatable packers both having the retraction assembly of FIG. 9, with the upper packer being inverted such that the low-pressure sides of both respective packers are fixed. The downhole tool of FIG. 12 is further equipped with an alternative centralizer to that shown in FIG. 11.

FIG. 12 shows a downhole tool 1200 equipped with a pair of inflatable packer elements 1212*a,b* both having a retraction assembly like assembly 910 of FIG. 9, with the upper packer 1212*a* being inverted such that the low-pressure sides (i.e., the inner end supports) of both respective packer elements are fixed. This is distinct from a typical dual packer configuration, wherein the lower end support of each of the first and second pairs of end supports is a movable end support to accommodate for packer inflation. When the pressure between the two such packer elements is decreased below hydrostatic pressure to induce formation fluid flow across the isolated portion (not shown in FIG. 12) of the borehole wall the upper side of the upper packer element Is loaded in tension, whereas the lower element is loaded in compression. The so-called "inverted" configuration of FIG. 12 depicts the upper packer element 1212*a* as being fixed at the bottom by a fixed end support 1222*a*, thus eliminating the tensile load at the upper end.

Thus, the upper packer element 1212*a* employs a movable upper end support 1220*a* and a fixed lower end support 1222*a*. Conversely, the lower packer element 12.12*b* employs a fixed upper end support 1220*b* and a movable lower end support 1222*b*. The movable end supports 1220*a*, 1222*b* cooperate with respective sleeves 1244*a*, 1244*b*, in analogous fashion to the movable end support 922 and sleeve 944 of FIG. 9, to actively retract the tubular packer elements 1212*a*, 1212*b* upon deflation thereof. Thus, the movable end support 1220*a* will be moved upwardly and the movable end support 1222*b* will be moved downwardly under ambient borehole fluid pressure acting on the differing inwardly-facing surface area ($A_1$+$A_2$) and outwardly-facing surface area $A_3$. Sealed low-pressure chambers (not numbered) permit movement of the movable end supports relative to the sleeves under ambient borehole fluid pressure.

The downhole tool of FIG. 12 is further equipped with an alternative centralizer to that shown in FIG. 11. The centralizer 1260 is similar to centralizer 1160 in that it employs hinged arms 1266 having first ends pivotally connected to the respective supports 1262, 1264 and second ends pivotally connected to each other at a pivotal joint 1268. The centralizer 1260 of FIG. 12 lacks spring blades like blades 1170 of FIG. 11, although such blades may optionally be applied (usually in open hole environments).

In this embodiment, the lower support 1264 is fixed and the upper support 1262 is movable. The upper support 1262 is moved axially along the mandrel 1250 by an actuator mat includes a piston 1280 and piston rod 1282. The piston is reciprocated within a cylinder 1284 by hydraulic fluid pressure, thereby moving the upper actuator upwardly and downwardly as desired to extend or retract the pivotally-connected ends 3268 of the hinged arms 1266. Upon such extension, the ends 1268 contact the borehole wall 1218 with sufficient force to hold the centralizer 1260 firmly within the borehole center. A helical spring 1286 secured about a reduced-diameter portion of the mandrel 1250 biases the upper support 1262 towards it upper position, whereby the ends 1268 are moved inwardly to a running position hi a default condition.

The side of the piston 1280 opposite the cylinder pressure has interval pressure (i.e., the pressure in the borehole interval isolated by the packer elements 1212*a,b* when inflated) acting on it. Thus, as the pressure drops in the interval, the force applied by the piston 1280 to piston rod 1282 will increase, even thought the piston cylinder pressure remains constant. This provides increasing force to the stabilizing arms 1266 and ends 1268 to counter the increasing buckling forces generated as the interval pressure drops. In applications where the centralizer piston 1280 does not require a significant pressure differential to achieve adequate centralizing force, the piston cylinder 1284 could be pressurized by the same fluid used to pressurize the packer elements 1212*a,b* (not necessarily on the same flow line) and the side of the piston 1280 opposite the cylinder pressure could be connected to hydrostatic pressure (i.e., the borehole pressure outside the packer interval). This way, the pressure on the piston 1280 would only be the packer inflation pressure.

The use of two or more actuating pistons would allow independent deployment of the centralizing arms 1266. This would, e.g., allow for centralization in a non-circular section of the borehole. Additionally, a plurality of such stabilizer sections could be used at the same time, which would allow any desired packer spacing or interval length.

In summary, several aspects of the present invention provide for reliably deploying a pair of spaced-apart inflatable packers carried about a mandrel disposed in a borehole penetrating a subsurface formation. Conventional formation evaluation with dual inflatable packers includes the steps of pressurizing the packers so as to isolate an annular portion of the borehole wall collecting one or more samples of formation fluid via the isolated portion of the borehole wall, and depressurizing the packers so as to permit movement of the mandrel within the borehole. The present invention provides a sampling method and apparatus that utilize one or more of the following to advantage: restricting deformation of the packers during inflation using an annular bracing assembly; actively retracting the packers using ambient borehole pressure; and substantially centralizing the mandrel intermediate the packers so as to resist buckling of the mandrel.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for using an inflatable packer assembly, the method comprising:

(a) deploying the inflatable packer assembly in a subterranean wellbore, the inflatable packer assembly including:

first and second axially spaced annular support members deployed about a mandrel, the first and second support members supporting corresponding first and second ends of the tubular element, at least the first support member being axially moveable along the mandrel; and wherein the first support member includes a stepped inner diameter, a first inner diameter at an axial end of the first support member facing an interior of the tubular element being less than a second inner diameter on an opposing axial end of the first support member;

(b) pressuring an expandable tubular element of the of the inflatable packer assembly in the wellbore; and (c) depressurizing the expandable tubular element thereby allowing a net axial fluid force caused by the first inner diameter being less than the second inner diameter to urge the first support member away from the second support member.

2. The method of claim 1, wherein movement of the first support member away from the second support member in (c) deflates the tubular element.

* * * * *